US009121258B2

(12) United States Patent
Kumar

(10) Patent No.: US 9,121,258 B2
(45) Date of Patent: Sep. 1, 2015

(54) SENSOR ON A DRILLING APPARATUS

(75) Inventor: Sunil Kumar, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 191 days.

(21) Appl. No.: 13/289,737

(22) Filed: Nov. 4, 2011

(65) Prior Publication Data

US 2012/0111633 A1 May 10, 2012

Related U.S. Application Data

(60) Provisional application No. 61/411,025, filed on Nov. 8, 2010.

(51) Int. Cl.
*E21B 47/007* (2012.01)
*E21B 47/00* (2012.01)

(52) U.S. Cl.
CPC ..... *E21B 47/0006* (2013.01)

(58) Field of Classification Search
CPC ..... E21B 47/0006
USPC ..... 166/66; 175/40; 73/152.48, 152.49, 73/152.59
See application file for complete search history.

(56) References Cited

U.S. PATENT DOCUMENTS 3,800,277 A * 3/1974 Patton et al. ..... 367/83
4,269,063 A 5/1981 Escaron et al.
4,294,318 A 10/1981 Desbrandes et al.
4,662,458 A 5/1987 Ho
4,715,451 A 12/1987 Bseisu et al.
4,747,456 A 5/1988 Kitagawa et al.
4,805,449 A 2/1989 Das
4,811,597 A 3/1989 Hebel
4,812,800 A 3/1989 Fuchs et al.
4,821,563 A 4/1989 Maron
4,858,710 A 8/1989 Krause
4,958,517 A 9/1990 Maron
5,184,516 A 2/1993 Blazic et al.
5,386,724 A 2/1995 Das et al.
5,705,757 A 1/1998 Wozniak
5,896,191 A 4/1999 Beier et al.
6,216,533 B1 4/2001 Woloson et al.
6,269,702 B1 8/2001 Lambson
6,404,107 B1 6/2002 Lazarus et al.
6,420,867 B1 7/2002 Goldfine et al.
6,729,187 B1 5/2004 Gregory
6,957,575 B2 10/2005 Boucher et al.
7,234,519 B2 6/2007 Fripp et al.

(Continued)

FOREIGN PATENT DOCUMENTS

WO 2009043589 4/2009

OTHER PUBLICATIONS

Bandorf, R. et al.; "Development of Me-DLC Films for Strain Gauge Applications," 2009 Society of Vacuum Coaters, 22nd Annual Technical Conference Proceedings, Santa Clara, CA., May 9-14, 2009, pp. 26-30.

(Continued)

*Primary Examiner* — Robert E Fuller
(74) *Attorney, Agent, or Firm* — Cantor Colburn LLP

(57) ABSTRACT

A drilling apparatus includes a drill string to be disposed in a borehole. The drill string includes a tubular, a borehole assembly coupled to the tubular and a drill bit disposed at an end of the borehole assembly. The apparatus includes a strain gauge directly deposited on the drill string.

21 Claims, 2 Drawing Sheets

(56) References Cited

U.S. PATENT DOCUMENTS

| | | | | |
|---|---|---|---|---|
| 7,325,605 | B2 | 2/2008 | Fripp et al. | |
| 7,793,558 | B2 | 9/2010 | Budde | |
| 7,948,197 | B2 | 5/2011 | Shackelford, IV | |
| 7,963,171 | B2 | 6/2011 | Gregory et al. | |
| 8,011,255 | B2 | 9/2011 | Arms et al. | |
| 8,342,031 | B2 * | 1/2013 | Jamshidi et al. | 73/780 |
| 8,397,562 | B2 | 3/2013 | Wassell et al. | |
| 8,438,931 | B2 | 5/2013 | Kazama et al. | |
| 8,695,729 | B2 * | 4/2014 | Kumar et al. | 175/50 |
| 2002/0070050 | A1 | 6/2002 | Wassell | |
| 2003/0150263 | A1 | 8/2003 | Economides et al. | |
| 2003/0183015 | A1 | 10/2003 | Richardson et al. | |
| 2004/0063238 | A1 | 4/2004 | Nagasaka et al. | |
| 2005/0100414 | A1 | 5/2005 | Salama | |
| 2005/0115329 | A1 | 6/2005 | Gregory et al. | |
| 2009/0090176 | A1 * | 4/2009 | Toribio et al. | 73/152.18 |
| 2009/0173162 | A1 | 7/2009 | Gregory et al. | |
| 2010/0326654 | A1 | 12/2010 | Hemblade | |
| 2011/0024188 | A1 | 2/2011 | Wassell | |
| 2011/0067925 | A1 | 3/2011 | Underwood et al. | |
| 2011/0286304 | A1 | 11/2011 | Thigpen et al. | |

OTHER PUBLICATIONS

Bandorf, R. et al.; "High Rate Deposition of Soft Magnetic Thick Films by Gas Flow Sputtering," 2007 Society of Vacuum Coaters, 50th Annual Technical Conference Proceedings (2007), pp. 473-476.

Bandorf, R. et al.; "High Rate Deposition of Magnetic Material by Gas Flow Sputtering," Plasma Processes and Polymers, 2007, 4, pp. S129-S133.

Bedenbecker, M. et al.; "Hard and soft magnetic materials for electromagnetic microactuators," Microsyst Technol, Technical Paper, 2008, 6 sheets.

Brunner "Piezoelectric Thin Film Transducers". Fraunhofer ISC, www.isc.fraunhofer.de. 2 pages.

Brunner "Piezoelectric Transducers for Structural Health Monitoring". Fraunhofer-Institut for Silicatforschung ISC www.isc.fraundofer.de. 2 pages.

Gerdes, H. et al.; "Sputter Deposition of Strain Gauges Using ITO/Ag," Plasma Processes and Polymers, 2009, 6, pp. S813-S816.

Heckmann, U. et al.; "New materials for sputtered strain gauges," Procedia Chemistry 1 (2009), Proceedings of the Eurosensors XXIII conference, pp. 64-67.

Notification of Transmittal of the International Search Report and the Written Opinion of the International Searching Authority, or the Declaration; PCT/US2013/026845, Jul. 17, 2013, 13 pages.

International Search Report and the Written Opinion of the International Searching Authority, or the Declaration for International Application No. PCT/US2011/059763; all references cited above.

* cited by examiner

SENSOR ON A DRILLING APPARATUS

CROSS-REFERENCE TO RELATED APPLICATIONS

This application takes priority from U.S. Provisional Application Ser. No. 61/411,025, filed on Nov. 8, 2010. which is incorporated herein in its entirety by reference.

BACKGROUND

1. Field of the Disclosure

This disclosure relates generally to drilling systems that include sensors for providing measurements relating to a parameter of interest, and, more specifically, to sensors located on a drill string.

2. Background of the Related Art

Oil wells (wellbores) or boreholes are usually drilled with a drill string that includes a tubular member having a drilling assembly (also referred to as the bottomhole assembly or "BHA") with a drill bit attached to the bottom end thereof. The drill bit is rotated to disintegrate the earth formation to form the wellbore. The drill string and BHA include devices and sensors for providing information about a variety of parameters relating to the drilling operations (drilling parameters), behavior of the BHA (BHA parameters) and formation surrounding the wellbore being drilled (formation parameters). Drilling parameters include weight-on-bit ("WOB"), rotational speed (revolutions per minute or "RPM") of the drill bit and BHA, rate of penetration ("ROP") of the drill bit into the formation, and flow rate of the drilling fluid through the drill string. The BHA parameters typically include torque, whirl, vibrations, bending moments and stick-slip. Formation parameters include various formation characteristics, such as resistivity, porosity and permeability, etc.

Sensors for determining force and torque are located on downhole portions of the drill string, BHA, tools or other portions of the drilling system. The sensors are attached by an adhesive to a tool or a mechanical member screwed onto the tool at the desired location. The adhesive may break down over time as the tool is exposed to high temperatures and pressures downhole. This can cause increased repair and maintenance costs.

SUMMARY OF THE DISCLOSURE

In an aspect, a drilling apparatus is provided, wherein the apparatus includes a drill string to be disposed in a borehole. The drill string includes a tubular, a borehole assembly coupled to the tubular and a drill bit disposed at an end of the borehole assembly. Further, the apparatus includes a strain gauge directly deposited on the drill string.

In another aspect, a drilling apparatus is provided, the apparatus includes a drill string to be disposed in a borehole. The apparatus further includes a strain gauge directly deposited on the drill string, the strain gauge including a sensor layer on an electrically insulating layer, the electrically insulating layer being directly deposited on a metallic substrate of the drill string.

Examples of certain features of apparatus and method for assessing quality of data have been summarized rather broadly in order that the detailed description thereof that follows may be better understood. There are, of course, additional features of the apparatus and method disclosed hereinafter that will form the subject of the claims made pursuant to this disclosure.

BRIEF DESCRIPTION OF THE DRAWINGS

The illustrative embodiments and their advantages will be better understood by referring to the following detailed description and the attached drawings, in which.

DETAILED DESCRIPTION

Figure 1:
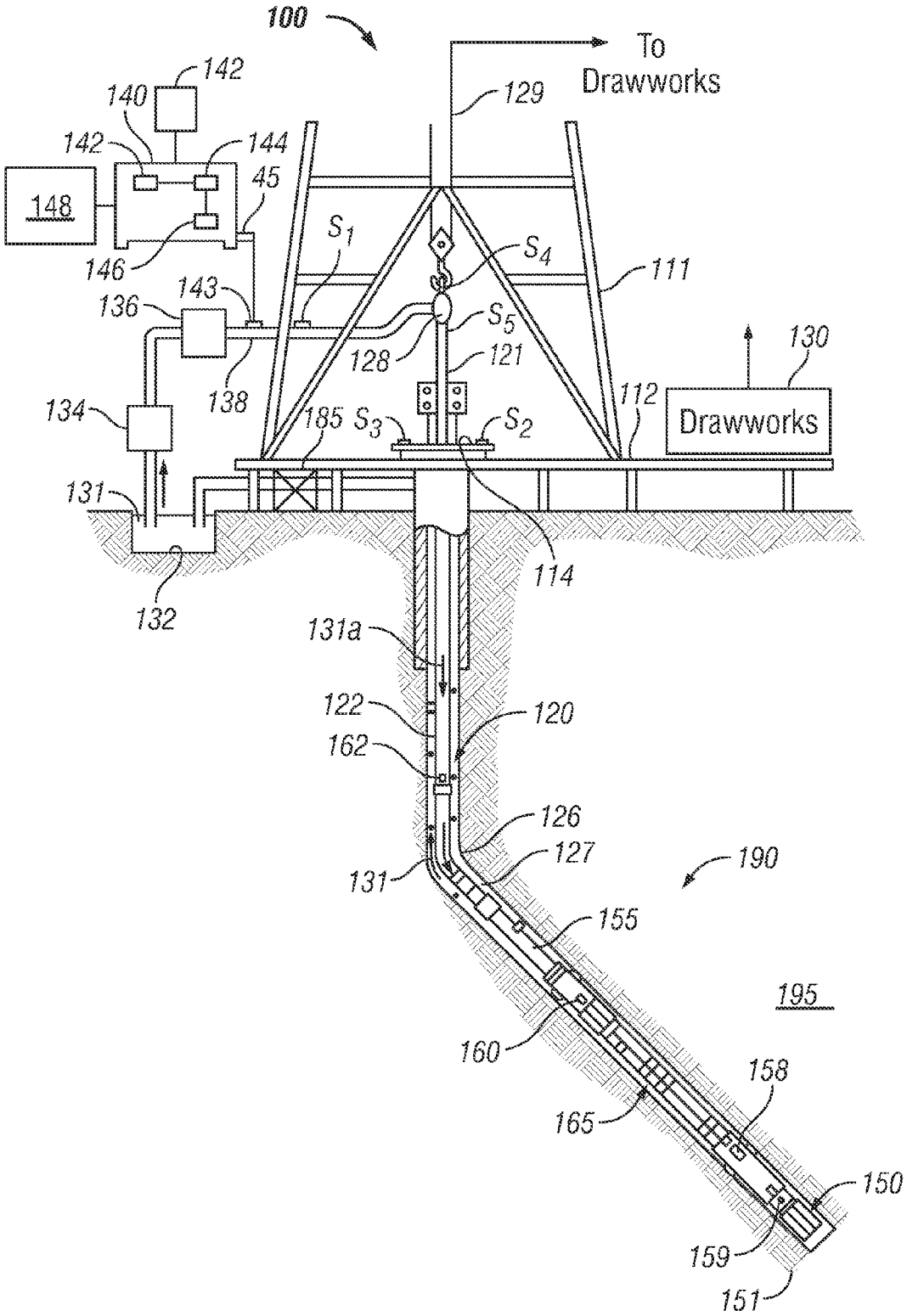
FIG. 1 shows an elevation view of an embodiment of a drilling system, where the drilling system includes sensors.

FIG. 1 is a schematic diagram of an exemplary drilling system 100. The drilling system 100 includes a drill string 120 that includes a drilling assembly or bottomhole assembly ("BHA") 190 conveyed in a borehole or wellbore 126. The drilling system 100 includes a conventional derrick 111 erected on a platform or floor 112 which supports a rotary table 114 that is rotated by a prime mover, such as an electric motor (not shown), at a desired rotational speed. A tubing (such as jointed drill pipe) 122, having the drilling assembly 190 attached at its bottom end extends from the surface to the bottom 151 of the borehole 126. A drill bit 150, attached to drilling assembly 190, disintegrates the geological formations when it is rotated to drill the borehole 126. The drill string 120 is coupled to a drawworks 130 via a Kelly joint 121, swivel 128 and line 129 through a pulley. Drawworks 130 is operated to control the weight on bit ("WOB"). The drill string 120 may be rotated by a top drive (not shown) instead of by the prime mover and the rotary table 114. The operation of the drawworks 130 is known in the art and is thus not described in detail herein.

In an aspect, a suitable drilling fluid 131 (also referred to as "mud") from a source 132 thereof, such as a mud pit, is circulated under pressure through the drill string 120 by a mud pump 134. The drilling fluid 131 passes from the mud pump 134 into the drill string 120 via a de-surger 136 and the fluid line 138. The drilling fluid 131 from the drilling tubular discharges at the borehole bottom 151 through openings in the drill bit 150. The returning drilling fluid 131 circulates uphole through the annular space 127 between the drill string 120 and the borehole 126 and returns to the mud pit 132 via a return line 135 and drill cutting screen 185 that removes the drill cuttings 186 from the returning drilling fluid 131*b*. A sensor $S_1$ in line 138 provides information about the fluid flow rate. A surface torque sensor $S_2$ and a sensor $S_3$ associated with the drill string 120 provide information about the torque and the rotational speed of the drill string 120. Rate of penetration of the drill string 120 is determined from the sensor $S_5$, while the sensor $S_6$ provides the hook load of the drill string 120.

In some applications, the drill bit 150 is rotated by rotating the drill pipe 122. However, in other applications, a downhole motor 155 (mud motor) disposed in the drilling assembly 190 also rotates the drill bit 150. In embodiments, the rotational speed of the drill string 120 is powered by both surface equipment and the downhole motor 155. The rate of penetration ("ROP") for a given drill bit and BHA largely depends on the WOB or the thrust force on the drill bit 150 and its rotational speed.

With continued reference to FIG. 1, a surface control unit or controller 140 receives signals from the downhole sensors and devices via a sensor 143 placed in the fluid line 138 and signals from sensors $S_1$-$S_5$ and other sensors used in the system 100 and processes such signals according to programmed instructions provided from a program to the surface control unit 140. The surface control unit 140 displays desired drilling parameters and other information on a display/monitor 142 that is utilized by an operator to control the drilling operations. The surface control unit 140 is a computer-based unit that includes a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 further communicates with at least one remote control unit 148 located at another surface location. The surface control unit 140 processes data relating to the drilling operations, data from the sensors and devices on the surface, data received from downhole and may control one or more operations of the downhole and surface devices.

The drilling assembly 190 also contains formation evaluation sensors or devices (also referred to as measurement-while-drilling, "MWD," or logging-while-drilling, "LWD," sensors) determining resistivity, density, porosity, permeability, acoustic properties, nuclear-magnetic resonance properties, corrosive properties of the fluids or formation downhole, salt or saline content, and other selected properties of the formation 195 surrounding the drilling assembly 190. Such sensors are generally known in the art and for convenience are generally denoted herein by numeral 165. The drill string 120 includes sensors 158, 159, 160 and 162 (also referred to as "sensor assemblies") positioned in various locations downhole. The sensors 158, 159, 160 and 162 are suitable sensors for determining downhole parameters, such as torque, weight-on-bit, pressure, stress, shock, vibration strain or other downhole parameter. Exemplary sensors 158, 159, 160 and 162 include strain gauges that are directly deposited on drill string 120. Accordingly, the sensors 158, 159, 160 and 162 exhibit improved accuracy and durability by being placed directly on a body of a portion of drill string 120, or tool.

With continued reference to FIG. 1, in embodiments, the sensors 158, 159, 160 and 162 are directly deposited using a suitable method, such as sputter deposition (also referred to as plasma deposition), laser machining, chemical vapor deposition or lithographic patterning of deposited layers. Such exemplary processes of directly depositing the sensors do not use adhesives to secure or couple the sensors in place, thereby improving durability of the sensor downhole. By directly depositing sensors 158, 159, 160 and 162 on the drill string 120, sensor assembly and calibration processes are simplified. For example, the sensors 158, 159, 160 and 162 are strain gauges that are calibrated after being directly deposited on the drill string 120. Further, there are no additional components or members to be coupled, adhered/glued or assembled to install the sensors 158, 159, 160 and 162 on drill string 120. Thus, there are fewer components to be accounted for during calibration. Further, during repair and maintenance of the drill string 120, the sensors 158, 159, 160 and 162 are not recalibrated after being pulled out of the wellbore 126. For example, other embodiments of downhole sensors are glued on a cantilever or other mechanical structure of the tool to measure a parameter, such as strain. The, sensors are recalibrated each time the tool is removed from the well. Recalibration occurs to account for a breakdown in the adhesive over time, which can alter the readings of a sensor. Thus, the recalibration step adds time and cost to the repair and maintenance process. Thus, by directly mounting sensors 158, 159, 160 and 162 on the drill string 120, repair and maintenance may reduce or eliminate re-calibration of the sensors. In addition, by directly depositing the sensors 158, 159, 160 and 162 on the drill string 120, the sensors 158, 159, 160 and 162 are able to withstand high temperature and pressure downhole environments. As depicted in FIG. 1, sensor 158 is positioned on BHA 190, sensor 159 is positioned on drill bit 150, sensor 160 is positioned on mud motor 155 and sensor 162 is positioned on a tubular of drill string 120.

Figure 2:
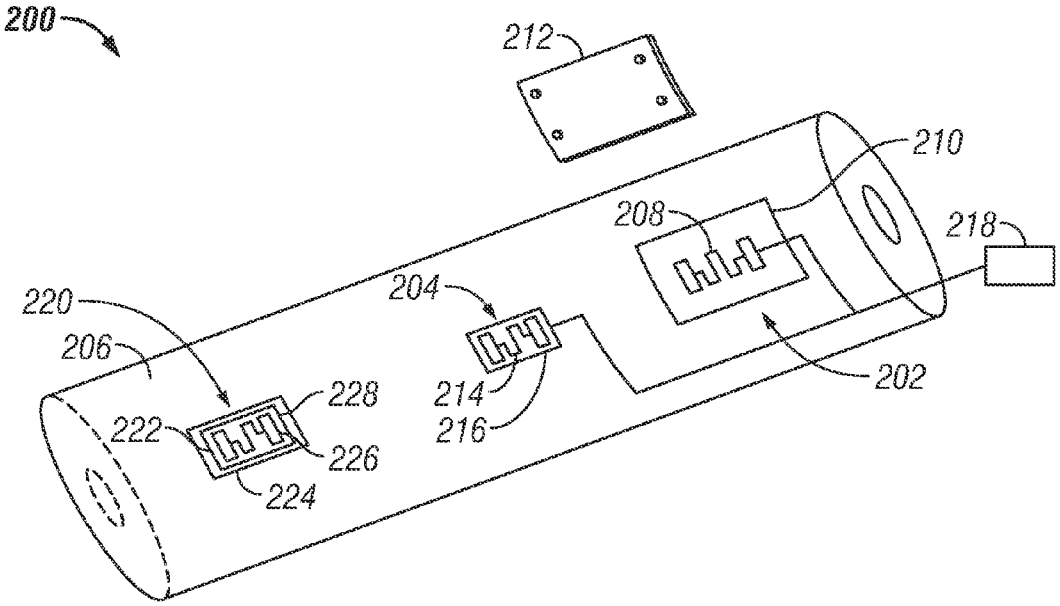
FIG. 2 is a perspective view of an embodiment of a downhole tool that includes sensor assemblies.

FIG. 2 is a perspective view of an embodiment of a downhole tool 200 that includes sensor assemblies 202 and 204. Exemplary sensor assemblies 202 and 204 are directly deposited on a body 206 of tool 200, using a suitable method, such as those described above. For example, the sensor assembly 202 includes an electrode 208 (also referred to as "thin film electrode") deposited by a sputter process on a recess 210 of the body 206. The sensor assembly 202 includes a cover piece 212, where the cover piece 212 is a suitable material and shape for protecting the electrode 208 from downhole conditions. An exemplary cover piece 212 comprises a metal or metal alloy, such as stainless steel, and protects the electrode 208 from damage. The sensor assembly 204 includes an electrode 214 positioned on an insulating layer 216, where the insulating layer 216 is positioned on the body 206. The insulating layer 216 is any suitable electrically insulating and thermally compatible layer for placement on or included as a part of tool 200. The insulating layer 216 improves the performance of sensor assembly 204 by insulating electrode 214. Examples of materials included in insulating layer 216 include a metallic oxide, silicone oxide, diamond-like coating, ceramic layer or a polymer. In an embodiment, the insulating layer 216 comprises $Al_2O_3$. In another embodiment, the insulating layer 216 is created by a chemical modification of the body 206 surface, such as by oxidizing aluminum to form the $Al_2O_3$ or nitriding a titanium layer or surface. The electrode 214 and insulating layer 216 are deposited on the body 206 by any suitable process, including those discussed above with reference to FIG. 1.

In an exemplary embodiment of sensor assembly 204, insulating layer 216 is sputter deposited on body 206 and then sensor or electrode 214 is sputter deposited on insulating layer 216. Exemplary methods for deposition or formation of insulating layer include 216 include (i) sputtering, (ii) evaporation, (iii) sol-gel spinning, (iv) spray coating, (v) screen printing and curing, (vi) ink printing and curing, (vii) chemical vapor deposition, and (viii) oxidation. In yet another embodiment, the insulating layer 216 is a part of the body 206. As depicted, a controller 218 is configured to transmit signals and power to and from the sensor assemblies 202 and 204. For example, the controller 218 provides excitation current to strain gauges in assemblies 202 and 204. In addition, the controller 218 processes and stores received signals corresponding to determined parameters, such as strain gauge measurements. The exemplary sensor assembly 220 is directly deposited on a member 222 which is coupled to or a structure extending from the body 206. In an embodiment, the sensor assembly 220 is located on member 222, which is positioned in recess 224. The member 222 is a suitable durable material such as stainless steel or an alloy that is coupled to body 206 via a fastener, weld, adhesive or other suitable coupling mechanism. In addition, the member 222 may be referred to as an amplification structure, where the structure is of a suitable shape to amplify parameters sensed by sensor assembly 222, such as strain or torque. Member 222 may be considered a removable portion of body 206. In an embodiment, member 222 is machined from a portion of the body 206. Electrode 226 and insulating layer 228 are deposited on member 222 by any suitable method, such as those discussed above. In an exemplary embodiment of sensor assembly 220, insulating layer 228 is sputter deposited on member 222 and electrode 226 is sputter deposited on insulating layer 228.

Figure 3:
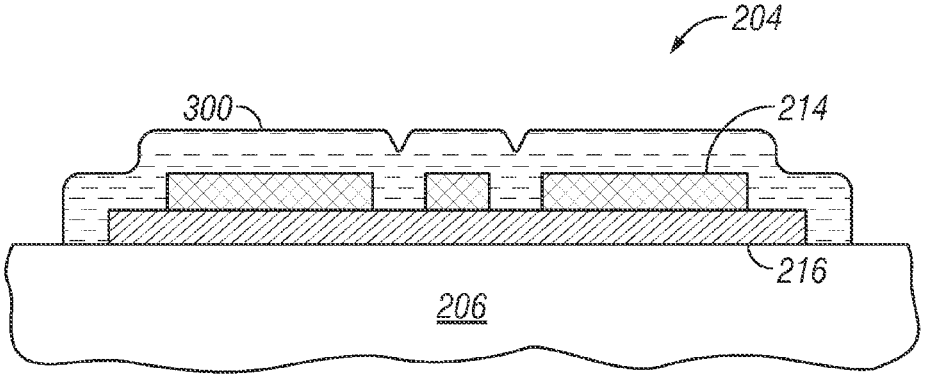
FIG. 3 is a detailed sectional side view of an embodiment of a sensor assembly.

FIG. 3 is a detailed sectional side view of sensor assembly 204. The sensor assembly 204 includes electrode 214, insulating layer 216 and protective layer 300. The protective layer 300 is configured to protect the electrode 214 from the downhole environment. The protective layer 300 may be any suitable durable and non-electrically conductive hard protective material. For example, the protective layer 300 includes $CH_4$ or diamond-like coating deposited by chemical vapor deposition on sensor 214. The electrode 214 is formed by directly depositing strain sensitive materials like NiCr or CuNi directly on insulating layer 216. Strain sensitive materials include, but are not limited to, piezoresistive materials, piezoelectric materials and magnetostrictive materials. Exemplary strain sensitive materials that achieve desired gauge factors, resistivity and compensation may also include a nickel containing diamond like carbon films and Ag-ITO compounds. The protective layer 300 is configured to resist abrasion and the downhole environment, thereby improving durability and reducing maintenance of the sensor assembly 204. As depicted, the body 206 is a metallic substrate on which sensor assembly 204 is directly deposited.

Exemplary processes for directly deposit exemplary sensors and sensor assemblies on a drill string, as shown in FIGS. 1-3, may include the following steps. A sensor or sensor assembly may be formed by laser machining the thin film electrode on the insulating layer. Various types of lasers can be used to etch the metal, the insulating surface on the substrate, the electrode material and the protective layer. An exemplary laser is an eximer laser. In the example, the layers are deposited and then ablated or etched using a laser. In another process, lithographical patterning of a deposited layer is used. This is achieved by first depositing the layer and patterning it using a photoresist and a mask. The photoresist is spun on top of the layer, and thereafter the surface containing the layer and photoresist is put under a mask (for example, made of chrome patterned on glass) and exposed with ultraviolet (UV) light. The pattern from the mask is transferred to the photoresist after suitable development of the photoresist. The photoresist left on the layer is then used to mask those areas from an etchant which can be either liquid, gaseous or plasma based. After the etching action is complete, the photoresist layer is stripped off to expose the patterned deposited layer. The formed pattern deposited layer may include the sensor or thin film electrode and the insulating layer.

In yet another example of forming the sensor assembly, the process includes plasma deposition or sputtering. One or more layers of the sensor, including the thin film electrode, insulating layer and protective layer, is deposited on the body or layer by placing the layer in a chamber where a plasma is created by radio frequency (RF) waves or direct current (DC) discharged between electrodes in a gaseous environment from which the requisite materials are deposited on the substrate in solid form. In another example, the sensor assembly is deposited by evaporation wherein a layer is deposited by heating the material to be deposited in a vacuum environment which then deposits on the layer or substrate. The layer can be patterned by etching or through a process such as lift-off. In another embodiment, the sensor or sensor layer is formed by evaporation or shadow masking. In an embodiment, the sensor may be applied to the body surface by screen printing or ink printing the sensor on the surface, then curing the sensor. In addition, any of the techniques may be used in combination to form the sensor.

In embodiments, a groove may be formed on the body, wherein a strain sensitive structure is then formed in the groove itself. In an embodiment, the sensor includes a piezoelectric material is embedded on the surface, a cantilever, in a cavity or groove of the tool body to allow measurement along various axes of the body. For example, the piezoelectric material may be embedded in a cavity of the tool body and configured to allow measurement of strain along the various axes of the body, wherein the measurements are used to monitor a health (i.e., an indication of remaining life or wear) of the tool.

While certain embodiments have been shown and described, various modifications and substitutions may be made thereto without departing from the spirit and scope of the invention. Accordingly, it is to be understood that the present invention has been described by way of illustration and not limitation.

What is claimed is:

1. A drilling apparatus comprising:

a drill string to be disposed in a borehole, the drill string comprising:

a tubular;

a borehole assembly coupled to the tubular; and a drill bit disposed at an end of the borehole assembly;

a sensor assembly on the drill string, the sensor assembly including an insulating layer on the tubular and a layer of strain sensitive material sputter deposited onto the insulating layer;

wherein a pattern is etched into the strain sensitive material after deposition to form a strain gauge.

2. The drilling apparatus of claim 1, wherein the sensor assembly further comprises a protective layer positioned over the strain gauge.

3. The drilling apparatus of claim 2, wherein the protective layer comprises one selected from the group of a protective coating and a cover piece.

4. The drilling apparatus of claim 1, wherein the insulating layer is formed directly on a metallic substrate of the drill string.

5. The drilling apparatus of claim 4, wherein the metallic substrate comprises one selected from the group consisting of: a body of the tubular, a body of the bit and a body of the borehole assembly.

6. The drilling apparatus of claim 4, wherein a groove is formed in the metallic substrate and the sensor assembly is formed in the groove.

7. The drilling apparatus of claim 1, wherein the insulating layer comprises one selected from the group consisting of metallic oxide, silicone oxide, diamond like coating, ceramic and a polymer.

8. The drilling apparatus of claim 1, wherein the strain gauge is embedded in a cavity formed in the drill string.

9. A drilling apparatus comprising:

a drill string to be disposed in a borehole;

an electrically insulating layer directly deposited on a metallic substrate of the drill string;

a strain sensitive material sputter deposited on the electrically insulating layer; and a strain gauge etched into the strain sensitive material after being deposited on the electrically insulating layer.

10. The drilling apparatus of claim 9, wherein the metallic substrate comprises one selected from the group consisting of: a body of a tubular, a body of a bit and a body of a borehole assembly.

11. The drilling apparatus of claim 10, wherein the strain sensitive material comprises a thin film electrode.

12. The drilling apparatus of claim 10, comprising a protective layer positioned on the strain gauge.

13. The drilling apparatus of claim 12, wherein the protective layer comprises one selected from the group of a protective coating or a cover piece.

14. A drilling apparatus comprising:

a drill string to be disposed in a wellbore;

a sensor assembly directly deposited on the drill string, the sensor assembly including:

an electrically insulating layer directly deposited on the drill string;

a strain sensitive material sputter deposited on the electrically insulating layer; and a strain gauge etched into the strain sensitive material after deposition of the stain sensitive material.

15. The drilling apparatus of claim 14, further comprising a protective layer positioned on the strain gauge.

16. The drilling apparatus of claim 14, wherein the strain sensitive material comprises a thin film electrode.

17. The drilling apparatus of claim 16, wherein the thin film electrode is etched on the electrically insulating layer by one selected from the group consisting of: laser machining and lithographic patterning.

18. The drilling apparatus of claim 16, wherein the thin film electrode comprises a strain sensitive material and the electrically insulating layer comprises one selected from the group consisting of metallic oxide, silicone oxide, diamond like coating, ceramic layer and a polymer.

19. A method of providing a sensor assembly for use in a borehole, comprising:

providing a drill string to be disposed in a borehole;

depositing a sensor assembly on the drill string by depositing an insulating layer direct on the drill string and sputter depositing a strain sensitive material direct on the insulating layer; and etching a pattern into strain sensitive material after deposition onto the insulating form a strain gauge of the sensor assembly.

20. The method of claim 19, further comprising forming a protective layer over the etched strain sensitive material.

21. The method of claim 19, further comprising etching the pattern using laser-machining.

* * * * *